US006328519B1

(12) United States Patent
Nagai

(10) Patent No.: US 6,328,519 B1
(45) Date of Patent: Dec. 11, 2001

(54) METHOD AND DEVICE FOR PRODUCING PRINTED PRODUCTS

(75) Inventor: Teruaki Nagai, Tokyo (JP)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/431,725

(22) Filed: Nov. 1, 1999

(30) Foreign Application Priority Data

Nov. 2, 1998 (EP) ..... 98811094

(51) Int. Cl.[7] ..... B42C 9/00

(52) U.S. Cl. ..... 412/8; 412/7; 412/37; 412/38

(58) Field of Search ..... 412/7, 8, 9, 37, 412/33, 38, 3, 4, 5, 6, 19, 20, 22

(56) References Cited

U.S. PATENT DOCUMENTS

| | | | | |
|---|---|---|---|---|
| 2,119,511 | * | 6/1938 | Perkins . | |
| 3,560,290 | * | 2/1971 | Sendor et al. . | |
| 4,403,896 | * | 9/1983 | Fabrig | 412/38 |
| 4,579,620 | * | 4/1986 | Flensburg et al. | 156/497 |
| 4,715,758 | * | 12/1987 | Stobb | 412/8 |
| 4,925,354 | * | 5/1990 | Cote | 412/8 |
| 4,928,995 | * | 5/1990 | Pickering et al. | 412/8 |
| 4,974,877 | * | 12/1990 | Azzato | 412/4 |
| 5,137,409 | * | 8/1992 | Honegger | 412/8 |
| 5,219,453 | * | 6/1993 | Furukawa et al. | 412/33 |
| 5,564,685 | * | 10/1996 | Reist | 412/37 |
| 5,570,985 | * | 11/1996 | Latvakangas et al. | 412/4 |
| 5,634,758 | * | 6/1997 | Leu | 41/37 |
| 5,667,211 | * | 9/1997 | Reist | 412/37 |
| 5,678,813 | * | 10/1997 | Osako et al. | 412/19 |
| 5,931,624 | * | 8/1999 | Naruse | 412/34 |
| 5,975,823 | * | 11/1999 | Schlough | 412/8 |
| 5,988,968 | * | 11/1999 | Hansmeier et al. | 412/37 |
| 5,988,969 | * | 11/1999 | Maes | 412/38 |
| 6,024,524 | * | 2/2000 | Braker et al. | 412/34 |
| 6,032,784 | * | 3/2000 | Bellanca et al. | 412/33 |

FOREIGN PATENT DOCUMENTS

| | | |
|---|---|---|
| 887 336 | 8/1953 | (DE) . |
| 37 20 641 A1 | 1/1988 | (DE) . |
| 0 390 734 A2 | 10/1990 | (EP) . |
| 0 664 226 A1 | 7/1995 | (EP) . |
| 2 491 392 | 4/1982 | (FR) . |

* cited by examiner

*Primary Examiner*—Allan N. Shoap
*Assistant Examiner*—Monica Carter
(74) *Attorney, Agent, or Firm*—Darby & Darby

(57) ABSTRACT

A method is disclosed for fabricating printed products, such as newsprint, brochures and the like, from folded signatures by partially joining the signatures together at the folded edges with an adhesive to form a bound spine. The signatures are moved astride on a saddle-shaped transport and collection path for applying a perforation on the fold and subsequently applying an adhesive to the perforation.

8 Claims, 1 Drawing Sheet

METHOD AND DEVICE FOR PRODUCING PRINTED PRODUCTS

BACKGROUND OF THE INVENTION

1. Field of the Invention

The present invention relates to a method and device for producing printed products, such as newsprint, brochures and the like, from folded signatures by partially joining the signatures at the folded edges with an adhesive to form a bound spine.

2. Description of the Related Art

Such methods are known in the art. With these methods, the fold of the signatures is perforated several times along its length from the inside out, so that the marginal sections of the perforation of the individual signatures are offset relative to each other from one signature to the next. The signatures are then collected with their flat sides contacting each other and transferred in the form of loose book blocks to a gluing machine. First, a cold-setting adhesive is rubbed in with a brush-type roller at the book spine protruding from the clamps, with the cold-setting adhesive penetrating into the perforation. Subsequently a hot-setting adhesive is applied by another roller. This method is referred to in the printing trade as "burst binding."

In another method referred to as "notch binding", after the milling and/or stripping operation, grooves extending transversely to the spine of a book block are milled in the adhesive binding device. The grooves are subsequently filled with an adhesive. Alternatively, the adhesive may also be an applied in two steps; for example, a cold-setting adhesive is applied first after the spine of the book block is milled or stripped. The book back is then dried and transversely extending grooves are milled in the conglutinated book back, the grooves subsequently filled by applying a hot-setting adhesive to the book back.

SUMMARY OF THE INVENTION

It is an object of the present invention to use an alternative method, which is different from the methods described above, of producing a printed product which is also bound using an adhesive.

According to the invention, the object is solved by moving the signatures astride on a saddle-shaped transport and collection path to apply a perforation at the fold and to subsequently glue the fold along the perforation.

The object is attained by the invention in a novel fashion whereby one or several signatures may be processed on the transport and collection path to form a printed product.

Advantageously, the signatures receive on the transport and collection path a punched or slotted perforation which at least approximately penetrates the height of the fold and continuously connects the fold with an adhesive.

It is particularly advantageous if the fold of the innermost signature of a printed product is not being perforated or does not have a perforation. In this way, all the signatures can be continually secured to each other.

In other words, regardless if one signature or several signatures are superimposed astride on the transport and collection path for applying a perforation, the first signature of a printed product has an innermost signature with a fold that is not perforated.

Preferably, the signatures designated for a printed product are perforated and glued together on the transport and collection path. It this way, a convenient channel for uninterrupted injection of the adhesive is established.

Alternatively, the innermost signature which has a fold that is not perforated, may be supplied as the first signature and separately to the transport and collection path.

Advantageously, a cover may be applied, wherein the cover may be supplied astride to the conglutinated signatures at the spine and pressed against the spine.

To optimally attach the cover to the spine of the bound signatures, an adhesive may be applied to the spine before the cover is placed on the spine.

The innermost signature of a printed product may also be supplied for the printed product at the end of a collection process by placing the section of a transport and collection path to which the innermost signature is supplied, at a lower level and by moving the previously collected signatures over the innermost signature at the end of the collection path.

A device is proposed for carrying out the method of the invention, wherein the device includes at least a signature feeder, followed by a binding device located along a transport and collection path. The device is characterized in that the transport and collection path is saddle-shaped for receiving and collecting signatures astride and includes between the signature feeder and the gluing machine a perforating device operating on the folds of the signatures. Both stamped and slotted perforations can be provided to which the adhesive is applied.

Advantageously, the perforating device is located above the transport and collection path so that the folds can be immediately processed.

The perforating device can be designed so as to move together with the transported signatures along its operating range.

Preferably, the depth of the perforation can be adjusted at the perforating device by raising and lowering the appropriate perforating tool.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

The invention will be described hereinafter with respect to an embodiment and with reference to the drawing to which reference is made with respect to all details not specifically described in the specification.

DETAILED DESCRIPTION OF THE PRESENTLY PREFERRED EMBODIMENTS

Figure 1:
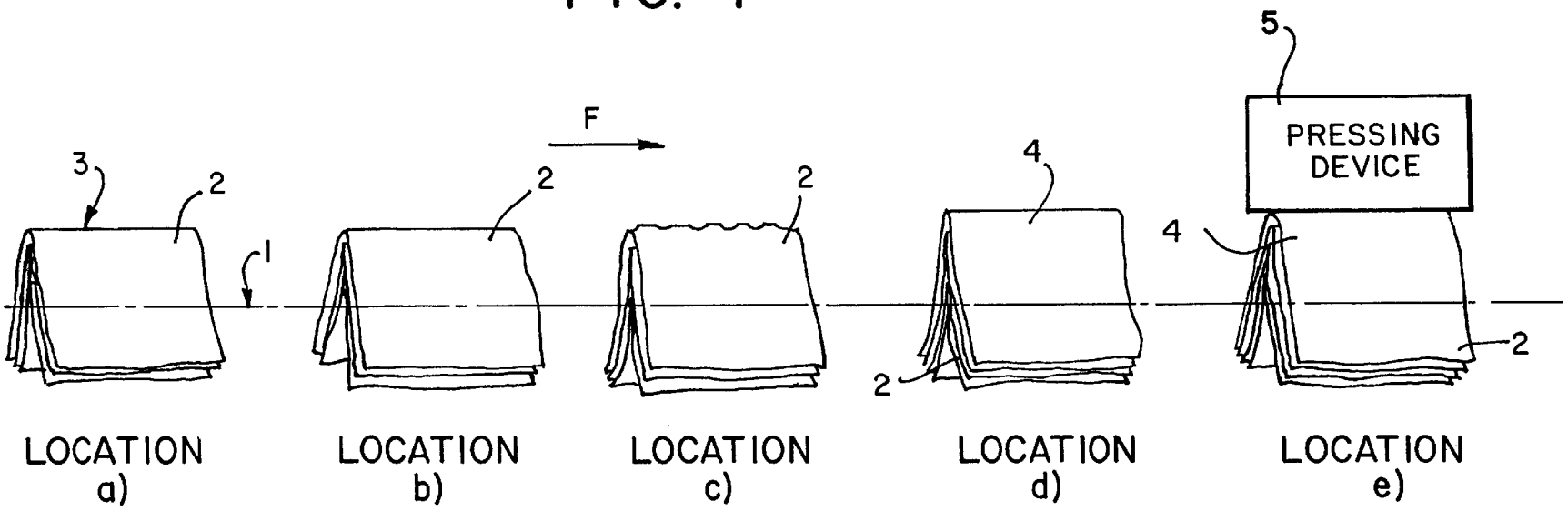
FIG. 1 shows schematically a collection process according to the invention for fabricating a printed product.

A location indicated with a) in FIG. 1 depicts the last collection position to which signatures 2 which are superimposed astride on a horizontal saddle-shaped transport and collection path 1, are supplied. The signatures 2 were previously supplied by a signature feeder arranged along the transport and collection path 1. In the present example, the printed product 3 which at this location is unattached and not bound, includes three signatures 2. The signatures 2 and the printed products 3, respectively, are moved on the transport and collection path 1 in the direction of the arrow F by a catch which projects upwardly on the transport and collection path 1 and is attached to a continuous chain and the like (not shown). The catch grips the rearward edge of the signatures 2 after the signatures have been placed on the transport and collection path 1. This transport system is known from so-called collecting staplers and will not be described in detail.

After the signatures 2 have been collected, the signatures 2 which are superimposed astride on the transport and collection path 1, reach the location b). There the signatures 2, which are pressed into each other at their respective folds along their length, are perforated by a tool operating from above or below. This process produces perpendicular channels through which an adhesive is injected at the location c) either from above, i.e., from outside the fold, or from below, i.e., from inside the fold. The adhesive is injected while the folds of the signatures 2 are pressed together, so that the proper amount of adhesive can be metered and pressed into the folds.

The supplied adhesive expands laterally in the channels and connects the individual signatures at the edges of the openings which penetrate the folds.

To keep the hardening or settling time of the adhesive short in order to quickly attain a stable form of the spine of the printed product, the pressure can be applied to the folds and maintained for a short period of time, for example, when the signatures 2 are transported onward. The injection device for the adhesive may therefore advantageously be separable from a clamping device which presses the signatures together and may move alongside the printed product 3.

After passing through the gluing machine indicated with the reference symbol c) and after the clamping device has been released, the signatures 2 reach the location d) on the transport and collection path 1 where a signature feeder (not shown) is used to place a cover 4 on the spine of the printed product 3 which is bound together by the adhesive. Preferably, the printed product 3 passes again through a gluing machine (known in the art, but not shown) to apply an amount of adhesive to the spine which is sufficient to secure the cover 4, before the cover 4 is placed on the printed product 3.

Subsequently, the cover 4 is pressed onto the spine of the last signature 2 by a pressing device 5.

A similar method can be used to produce printed products 3 which consist only of a single signature 2. The desired perforation may be applied to the signature 2 after the signature 2 has been printed or before the signatures are decollated in the signature feeder.

The folds should be perforated and glued together with care, paying particular attention to the way the adhesive penetrates the perforation and the signatures are connected to each other.

The transport and collection path should be covered to prevent the region where the adhesive is applied from becoming contaminated by the adhesive. For example, the innermost signature of the printed product may not be perforated. The innermost signature 2 may be perforated after printing or an innermost, non-perforated signature may be supplied by a first signature feeder located on the transport and collection path.

Because a signature may be quite thin, perforating a signature while leaving out the innermost signature on the transport and collection path 1 may not be reliable without taking additional precautions.

When an adhesive is applied to the folds of a printed product 3 which consists of at least one signature 2, the folds should be pressed together so that the adhesive cannot exit between the legs of the signatures.

Alternatively, the innermost signature 2 of a printed product 3 may also be supplied at the end of the collection path. The previously collected signatures 2 should then be lifted from the transport and collection path 1 or placed on the innermost signature 2.

A cover 4 may be placed on the signatures 2, either after the adhesive has been applied or at the same time the adhesive is applied, on the transport and collection path 1. If the cover 4 is placed separately on the spine, then another application of adhesive may have to be applied on the spine of the glued signatures.

A device for carrying out the method of the invention includes at least one signature feeder, followed by a gluing machine arranged along a transport and collection path 1, wherein revolving grippers or catches are provided for transporting the signatures 2 which are placed astride on the transport and collection path 1. The grippers or catches grip the respective rearward ends of the signatures 2 and transfer the signatures 2, after these have been collected, to a perforating device which punches or stamps the folds of the signatures.

The folds are perforated and adhesive is applied to the folds while the folds are pressed together by a hold-down device.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method of fabricating a printed product from folded signatures of printed sheets comprising the steps of forming folded edges of the printed sheets for providing folded signatures;

placing the folded signatures astride on a saddle-shaped transport and collection path;

moving the folded signatures astride on the saddle-shaped transport and collection path;

perforating the folded edges of the signatures while the folded signatures are moving by providing a slotted perforation which at least approximately penetrates the height of the fold and wherein the perforation is performed such that the folded edge of the innermost signature of a printed product is not being perforated;

applying an adhesive to the folded edges of the signatures while the signatures are moving;

partially conglutinating the signatures to each other at the folded edges to form a bound spine.

2. The method according to claim 1, wherein the conglutinating step is performed on the transport and collection path.

3. The method according to claim 1, further comprising a step of supplying an additional non-perforated innermost signature to the transport and collection path.

4. The method according to claim 1, further comprising a step of supplying an additional non-perforated signature as a last signature to the other signatures of the printed product.

5. The method according to claim 3, further comprising a step of pressing the folded edges of the signatures of a printed product together.

6. The method according to claim 5, further comprising the step of supplying a cover astride to the signatures, the cover being perforated and provided with an adhesive.

7. The method according to claim 5, further comprising the step of supplying a cover having a fold and being placed astride to the signatures, the cover being provided with an adhesive, and being pressed against the spine.

8. The method according to claim 5, further comprising the step of supplying a cover having a fold and being placed astride to the signatures, the adhesive being applied to the spine before the cover is supplied.

* * * * *